US005486046A

United States Patent [19]

Jernstrom et al.

[11] Patent Number: 5,486,046

[45] Date of Patent: Jan. 23, 1996

[54] CANTILEVER SLIDE OUT REFRIGERATOR SHELF

[75] Inventors: Nana B. Jernstrom; Jeffrey N. Wilson, both of Louisville, Ky.

[73] Assignee: General Electric Company, Louisville, Ky.

[21] Appl. No.: 265,215

[22] Filed: Jun. 24, 1994

[51] Int. Cl.[6] ..... A47B 96/06

[52] U.S. Cl. ..... 312/408

[58] Field of Search ..... 312/408, 404, 312/334.23, 334.16, 334.34, 348.1, 330.1; 211/187, 90; 108/143

[56] References Cited

U.S. PATENT DOCUMENTS

| | | | |
|---|---|---|---|
| 2,276,942 | 3/1942 | Dibble | 312/408 X |
| 2,701,174 | 2/1955 | Franks | 312/330.1 X |
| 3,984,163 | 10/1976 | Boorman, Jr. et al. | 312/408 |
| 4,109,797 | 8/1978 | Brunette | 211/187 X |
| 4,122,955 | 10/1978 | Celms | 211/187 X |
| 4,646,658 | 3/1987 | Lee | 108/143 |
| 4,669,692 | 6/1987 | Mastrodicasa | 211/187 X |
| 4,735,470 | 4/1988 | Falk | 312/408 X |
| 4,776,472 | 10/1988 | Rosen | 211/187 |
| 5,088,607 | 2/1992 | Risafi et al. | 211/187 X |
| 5,205,421 | 4/1993 | Bustos | 211/187 X |
| 5,340,209 | 8/1994 | Kolbe et al. | 312/408 |

FOREIGN PATENT DOCUMENTS

| | | | |
|---|---|---|---|
| 507455 | 7/1992 | United Kingdom | 312/408 |

*Primary Examiner*—José V. Chen
*Assistant Examiner*—Rodney B. White
*Attorney, Agent, or Firm*—H. Neil Houser

[57] ABSTRACT

A storage basket assembly for a refrigerator includes a pair of ladder tracks secured to the rear wall of a storage compartment and a pair of supports with bases secured to the tracks, vertical walls extending forward of the bases; basket support surfaces above the vertical walls and flanges projecting inward of the support surfaces. The bottom wall of a storage basket has spaced apart elongated rods extending front to rear of the compartment. A pair of mounting members interfit with adjacent pairs of rods along the lateral edges of the basket bottom wall. Each mounting member has a mounting surface resting on the support surface of the corresponding support for sliding movement of the basket. Each mounting member has lips which extend down inside and outward under the flange of the corresponding support.

10 Claims, 3 Drawing Sheets

CANTILEVER SLIDE OUT REFRIGERATOR SHELF

BACKGROUND OF THE INVENTION

This invention relates to storage assemblies for refrigerators and, more particularly, to refrigerator storage basket assemblies.

Many refrigerators have various storage assemblies which include open wire support structures, such as shelves and baskets. For example wire shelves are common in both fresh food storage compartments and in freezer storage compartments. Wire baskets are very often found in freezer compartments, particularly in side-by-side refrigerators. It is desirable to make such storage shelves and baskets slideable. That is, it is advantageous that they slide between a first position fully within the storage compartment and a second position partially out of the compartment for loading and unloading items.

Such open wire shelves and baskets have been mounted on supports suspended from ladder tracks at the rear of the storage compartment and some such assemblies have enabled the shelf or basket to move horizontally between a fully seated position and a partly exposed position. However, such assemblies were expensive and did not provide optimum operation.

An object of the present invention is to provide an improved open wire support structure assembly which is easily movable between a first position, fully within the storage compartment, and a second position partially out of the compartment.

Another object of this invention is to provide such an improved structure that includes a minimum number of economical parts and is easy to assemble.

SUMMARY OF THE INVENTION

A refrigerator storage assembly includes a pair of elongated support members mounted in side-by-side relationship in a refrigerator storage compartment. Each of the support members has a storage structure support surface extending front to rear in the compartment and a flange extending along the support surface and projecting toward the other support member. A storage structure includes a plurality of elongated rods extending in spaced apart, side-by-side relationship front to rear of the structure. A pair of elongated mounting members interfit with adjacent pairs of rods adjacent the lateral edges of the structure. Each mounting member has a mounting surface which engages the support surface of the corresponding support member for sliding movement of the storage structure along the support members. Each mounting member has a plurality of lips which extend downward inside and outward under the flange of the corresponding support member.

Each support member includes a tab projecting inward, toward the other support member, near its front, to engage the front most lip of the corresponding mounting member and prevent outward movement of the storage structure beyond a predetermined position partially out of the storage compartment. A removable stop member is inserted into each support member at a position to engage a corresponding mounting member and prevent inward movement of the storage structure beyond its predetermined position fully within the storage compartment.

DETAILED DESCRIPTION OF PREFERRED EMBODIMENT

Figure 1:
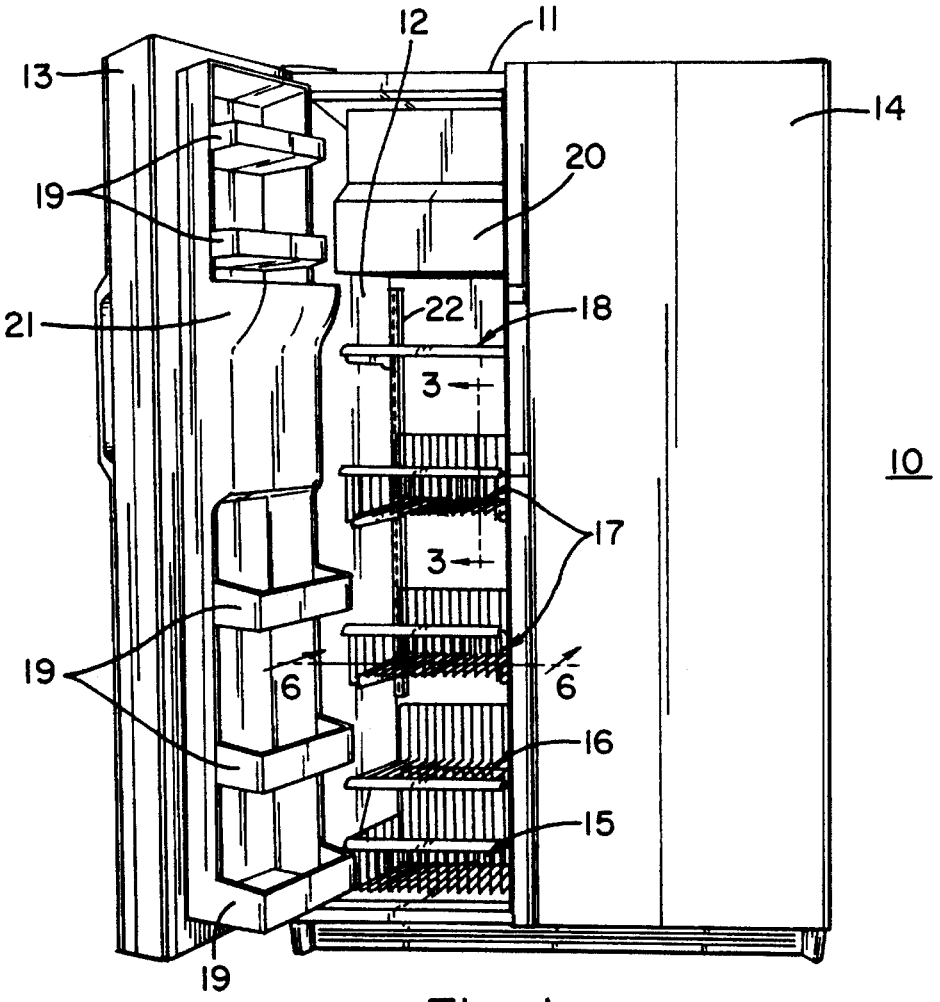
FIG. 1 is a simplified front perspective view of a side-by-side refrigerator with a basket assembly incorporating one embodiment of the present invention.

Referring particularly to FIG. 1, there is shown a household refrigerator 10 of the side-by-side type; that is the cabinet 11 includes a freezer storage compartment 12 and a fresh food storage compartment arranged in a side-by-side configuration. Each of the storage compartments has a front access opening which is normally closed by hinged doors 13 and 14 respectively. The particular refrigerator structure is shown for illustrative purposes only and it will be understood as the description progresses that the present invention is also applicable to other types of refrigerators such as, for example, top mount refrigerators in which the freezer storage compartment is positioned above the fresh food storage compartment. Various operating components of refrigerators, such as the refrigeration system for example, are not involved with the present invention and have been omitted for the sake of simplicity.

Typically the freezer storage compartment 12 is provided with several storage support structures on which various items are placed for storage at below freezing temperatures. For example, the illustrative freezer compartment 12 has a lower stationary basket 15 and shelf 16, two vertically adjustable baskets 17 and an upper vertically adjustable shelf 18. In addition the door 13 includes shelves 19. Also, many more fully featured refrigerators include automatic ice makers 20 and through the door dispensing mechanisms 21.

Figure 2:
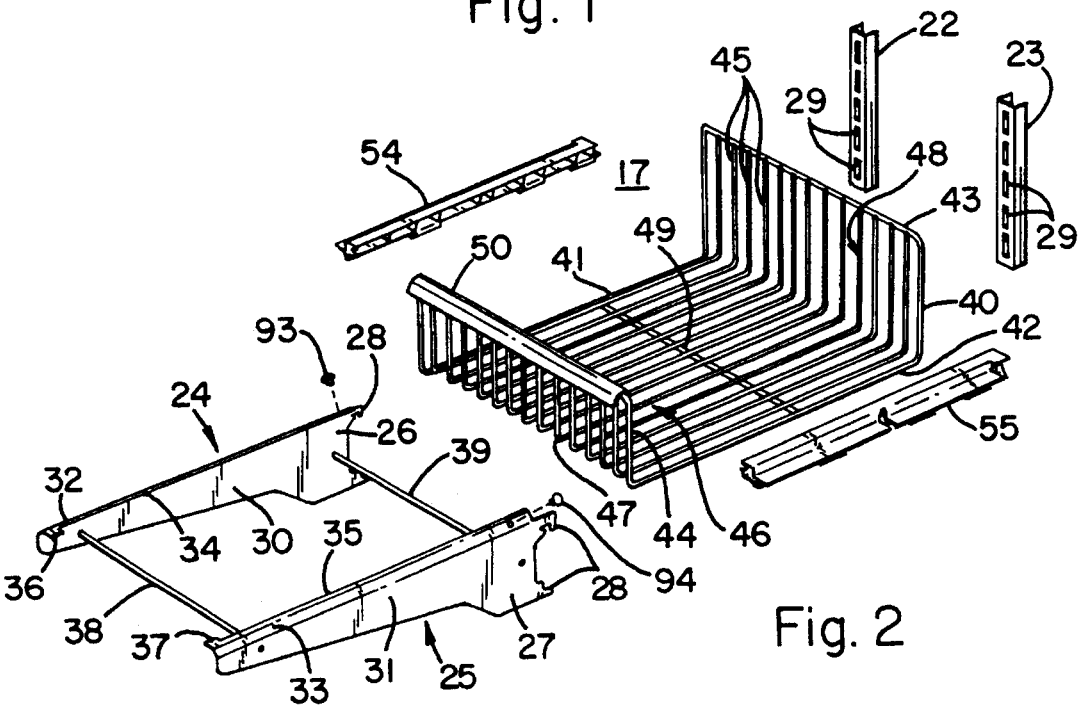
FIG. 2 is a simplified, exploded view of a basket assembly in the refrigerator of FIG. 1.
Figure 4:
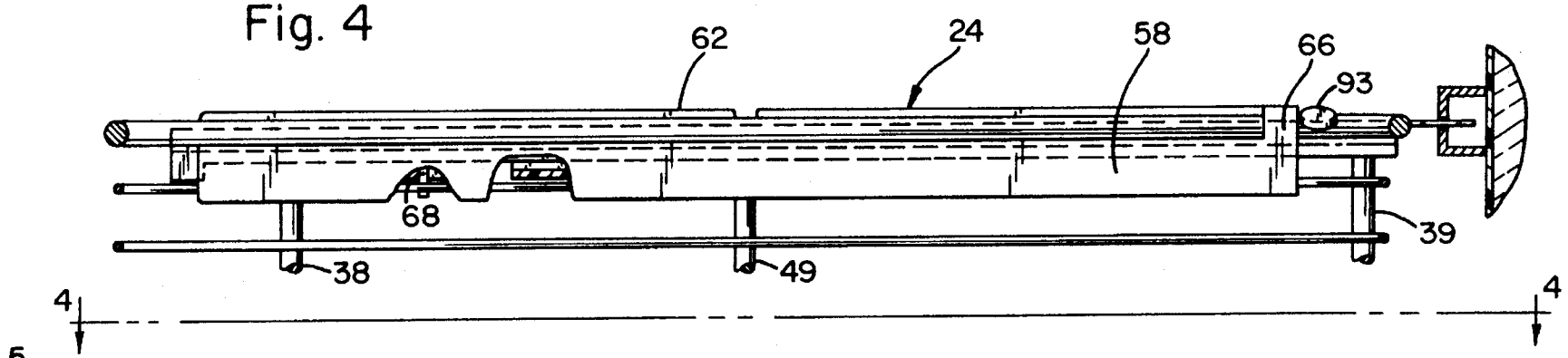
FIG. 4 is a fragmentary plan view of the shelf assembly as seen along line 4—4 in FIG. 3.
Figure 3:
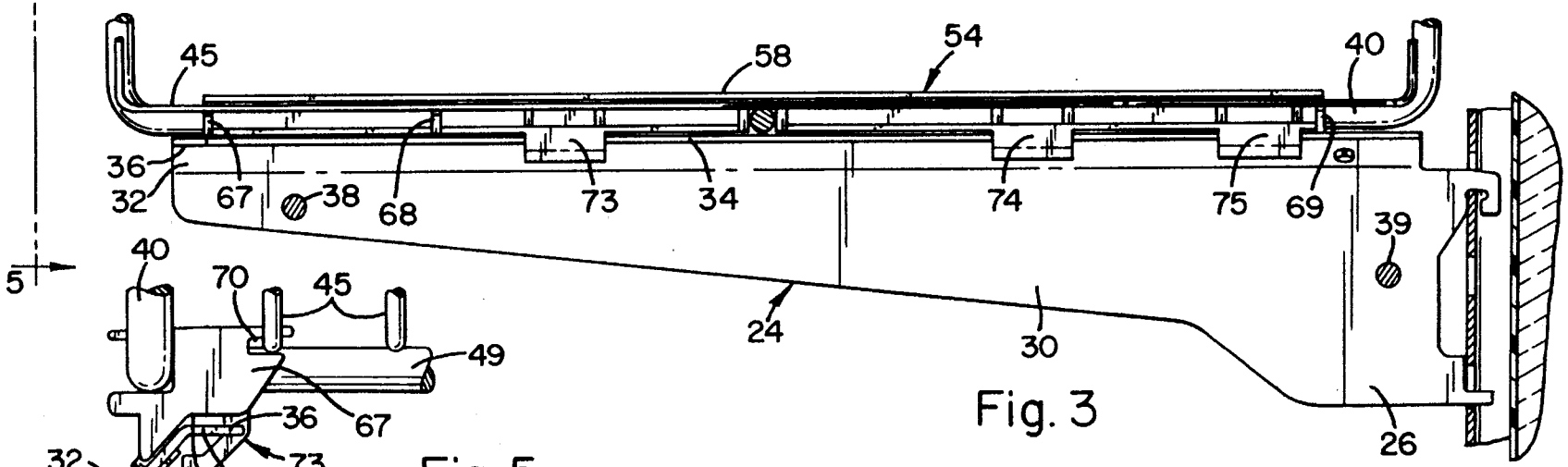
FIG. 3 is a cross section view of the basket assembly as seen along line 3—3 in FIG. 1.
Figure 5:
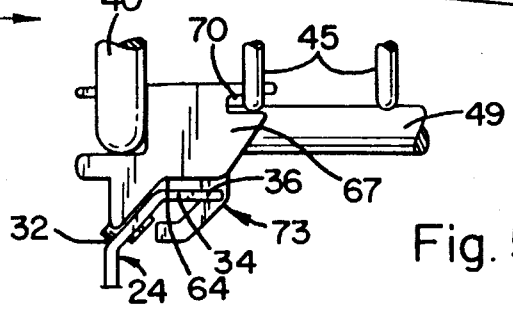
FIG. 5 is a fragmentary front elevation view as seen along line 5—5 in FIG. 3, illustrating the left lateral edge portion of the basket assembly.

Viewing now FIGS. 1 and 2, it is well known to provide shelves, baskets and drawers with flexibility of vertical positioning within the storage compartment by use of a cantilever mounting including a pair of elongated ladder tracks 22, 23, which are mounted to the rear wall of the storage compartment in spaced apart, vertically extending relationship. A pair of storage structure support members 24, 25 have base portions 26, 27 with spaced apart hooks 28 that are received in openings 29 in the ladder tracks to mount the support members to the tracks. Support member 24 includes a generally vertically oriented wall 30 extending forward from the base portion 26, a storage structure support surface 32 extending along the top edge of the wall 30 and a flange 34 extending along the upper edge of the surface 32. The support surface 32 is angled from the vertical so that the outer face of surface 32 faces upward and outward. The flange 34 projects inward from the upper edge of surface 32 toward the other support member. A horizontal tab 36 extends even further inward from the forward portion of the flange 34. Similarly support member 25 includes a generally vertical wall 31 extending forward of base portion 27, an upward and outward facing storage structure support surface 33 extending along the upper edge of wall 31, a horizontal inwardly projecting flange 35 along the upper edge of surface 33 and a inwardly projecting tab adjacent to the front of flange 35. A pair of braces 38, 39 extend between the support members 24, 25 and assure that the support surfaces 32, 33, flanges 34, 35 and tabs 36 37 are at predetermined distances apart across the freezer compartment.

The support member assembly, including support members 24, 25, is particularly adapted to support open wire structures, such as baskets and shelves, for selective movement between a first predetermined position within the freezer storage compartment and a second predetermined position partially out of the storage compartment for loading and unloading items to be stored in the compartment. Basket 17 is illustrative of a basket construction particularly suitable for use with the support members 24, 25. Each basket 17 is of an open wire construction with a heavy gage wire or rod 40 which extends around the periphery of the basket. The rod 40 is bent into a generally rectangular outline with sides 41, 42 and ends 43, 44. Additional elongated wires or rods 45 extend in spaced apart relationship between the end portions 43, 44 of rod 40, parallel to the side portions of 41, 42 of rod 40. Typically the rods 45 are of a lighter gage than rod 40. The front and rear portions of the rods 40 and 45 are bent at right angles to form the basket 17 with a horizontal bottom wall 46 and upstanding front and rear walls 47, 48 respectively. A cross rod 49 extends across the basket bottom 46 at right angles to the rods 40, 45 and is connected to them by some suitable means, such as welding, to provide strength and stiffness to the basket. In the event the basket is very large or it is desired to use lighter gage wires or rods, additional cross rods may be included. A handle 50 is attached to the upper edge of basket front portion 47 for the convenience of users in moving the basket into and out of the freezer.

A pair of mounting members 54, 55 interfit with the portion 41, 42 of rod 40 along each lateral side of the basket bottom wall 46 and with the corresponding portion of the adjacent smaller gage wires or rods 45. Referring now to FIGS. 3–8, mounting member 54 includes an elongated vertical wall or web 56 with a horizontal top wall 58 projecting inward along its upper edge. A first elongated lower wall 60 projects horizontally inward of the web 56 in spaced relationship to top wall 58. A second elongated lower wall 62 projects horizontally outward of web 56 below the top of the web. While the lower walls 60, 62 are shown as being aligned, such an arrangement is not required and they may be off set from each other if desired. Below the lower walls 60, 62 the member 54 is formed with an elongated mounting surface 64. It will be seen in FIG. 6 that, when the basket is assembled, the support surface 64 lies in a plane angled so that mounting surface 64 faces downward and inward.

Figure 8:
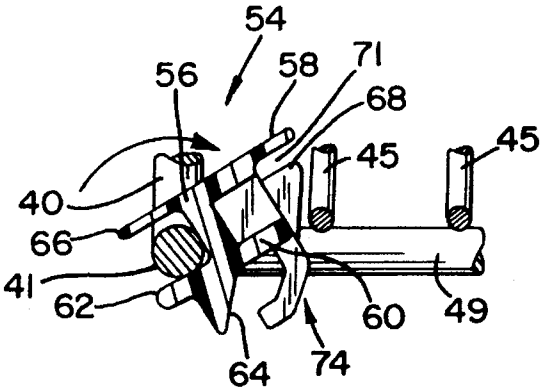
FIG. 8 is a fragmentary front elevation view similar to FIG. 6, but illustrating the mounting member in a partly assembled configuration.
Figure 10:
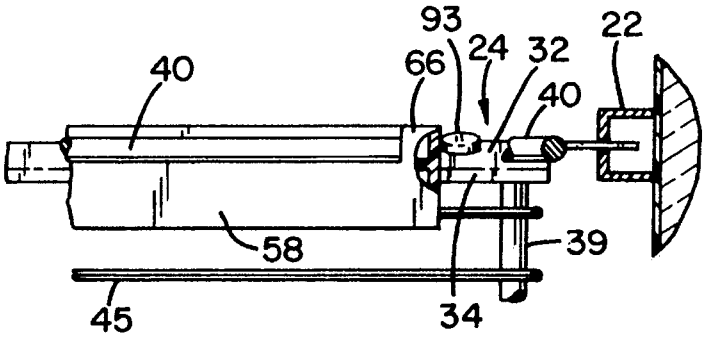
FIG. 10 is a fragmentary plan view similar to FIG. 9, but illustrating the basket assembly in its predetermined position fully within the freezer storage compartment.
Figure 9:
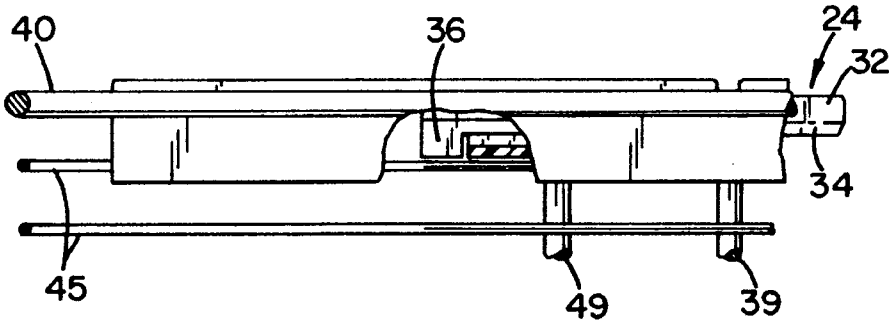
FIG. 9 is a fragmentary plane view, partly broken away, of the left lateral edge portion of the basket assembly, illustrating the predetermined position partly out of the refrigerator compartment.

The outside of vertical web 56 and the top of lower wall 62 form an L-shaped recess to receive the corresponding portion 41 of rod 40. A horizontal tab 66 projects outwardly of the top rear portion of web 56 opposite top wall 58 and fits closely over the rod 40. Three vertically oriented ribs 67, 68 and 69 project inward of the web 56 and are spaced slightly below the bottom of top wall 58 to provide detents, such as those at 70 and 71. The left most lighter wire or rod 45 fits closely within the detents between each of the ribs 67–69 and the top wall 58. In this way the mounting member interfits with corresponding portions of rod 40 and the adjacent rod 45 to integrate or firmly connect the basket and mounting member. To mount member 54 on the basket 17 the member is first angled as shown in FIG. 8 and inserted onto the left side portion 41 of rod 40 along the bottom wall 46 of the basket, with the tab 66 overlying rod 40. Next the member is rotated clockwise to the position of FIG. 6, with the corresponding portion of the adjacent rod 45 received in the detents formed by horizontal top wall 58 and ribs 67–69.

Figure 6:
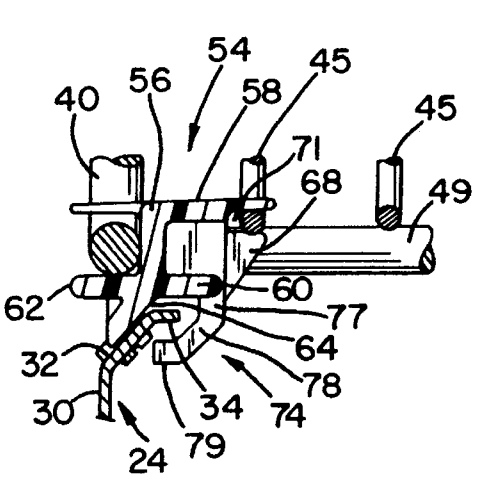
FIG. 6 is a fragmentary front elevation view as seen along line 6—6 in FIG. 1, showing the left lateral edge portion of the basket assembly.

Three lids 73, 74 and 75 depend from the inner portion of lower wall 60, in spaced apart relationship front to rear of the member 54. More particularly, the front most lip 73 is a predetermined distance to the rear of the front of member 54 and is to the rear of rib 68. Lip 75 is adjacent the rear end of member 54 and the lip 74 is spaced between lips 73 and 75. As seen in FIG. 6, lip 74 has an upper portion 77 which projects downward of the wall 60, a middle portion 78 which angles outward and lower portion 79 which projects horizontally outward. The other ribs 73, 75 have corresponding shapes.

Figure 7:
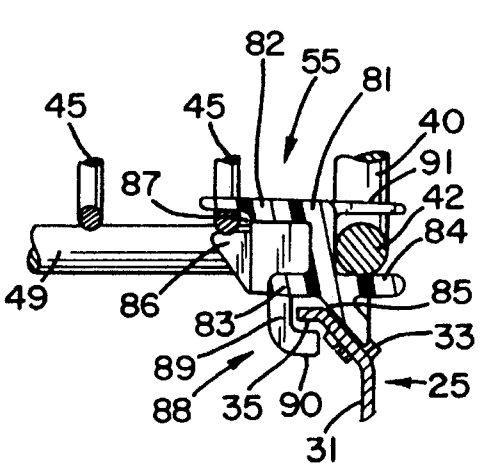
FIG. 7 is a fragmentary front elevation view similar to FIG. 6, but illustrating the right lateral edge portion of the basket assembly.

The mounting member 55 conveniently may be substantially a mirror image of mounting member 54, except only for two minor modifications. Referring to FIG. 7, the member 55 has an elongated vertical web 81 with an elongated top 82 wall projecting inward of its upper edge. A first horizontal lower wall 83 projects inward of the web and is spaced below top wall 82 and a second lower wall 84 projects outward of the web in alignment with wall 83. Below wall 84, member 55 includes a mounting surface 85 which lies in a plane angled so that surface 85 faces downward and inward. There are three ribs, such as 86, spaced below wall 82 to form detents, such as 87, to receive a corresponding rod 45. There are three depending lips, such as 88. The ribs and lips are spaced apart along the member 55 in a manner substantially the same as the ribs 67–69 and lips 73–75 are spaced apart along member 54. However, wall 83 does not project inward as far as wall 60 and lips 88 have a slightly different shape than lips 73–75. More specifically each of the lips 88 includes a first portion 89 which projects downward from wall 83 and a second portion 90 which projects outward of the lower edge of portion 89. The mounting member 55 is connected to or mounted on a basket 17 in a manner substantially like member 54. That is, first the member is angled and the junction between web 81 and lower wall 84 is placed on rod 40 with a tab 91 at the rear of member 55 positioned over the rod. Then member 55 is rotated counter-clockwise until the corresponding portion of the adjacent rod 45 is received in the detents 87 between the ribs 86 and top wall 82.

Once both of the mounting members 54, 55 are mounted on a basket 17, the basket is mounted on a pair of support members 24, 25 before the support members are mounted in the refrigerator storage compartment. More specifically, the mounting members 54, 55 are inserted over the support members 24, 25 respectively from the rear of the support members, with the mounting member mounting surfaces 64, 85 resting on the support member support surfaces 32, 33, respectively, and with the lower portions of the lips 73–75 and 88 projecting under the flanges 34, 35 respectively. The mating support surfaces and mounting surfaces provide the basket with a sliding mount for movement between a first position fully received within the freezer 12 and a second position partly out of the freezer.

Removable stop members 93, 94 are mounted in openings at predetermined positions in support member support surfaces 32, 33 respectively after the basket is mounted on the support members. The stop members engage the rear end of the mounting members 54, 55 and prevent the basket from being inserted so far into the freezer that the rear 48 of the basket would strike the rear wall of the freezer compartment. Similarly, when the basket 17 is pulled outward of the freezer compartment, the front most lips of the mounting members eventually will engage the tabs 36, 37 on the support members and prevent further outward movement of the basket. The front most or forward lips are positioned a predetermined distance to the rear of the front of the mounting members to provide the basket with a predetermined partial open position. The middle rib on each mounting member, such as rib 68 on member 54, is positioned sufficiently far in front of the front lip that the middle ribs will be forward of the front of the support members when the basket is in its second or partially open position. This assures that the basket has sufficient support from the mounting members, even in its most open position.

Conveniently the support members are made of powder painted steel and the mounting members are molded from a suitable plastic material such as ABS with 2% silicone. This assures that the basket will move smoothly into and out of the freezer. The inward/upward orientation of the support member support surfaces and the downward/outward orientation of the mounting member mounting surfaces assists in centering the basket between the support members. The lips 88 of mounting member 55 are closely spaced from the flange 35 of support member 25 to guide the basket for movement straight into and out of the freezer. On the other hand the lips 73–75 of mounting member 54 are spaced further from the flange 36 to accommodate any build-up of manufacturing tolerances. The overlapping of the lower portions of the lips with the support member flanges prevent the basket being lifted off the support members or the front of the basket tipping downward when the basket is moved to its outward position.

While the present invention has been illustrated and described as embodied in a particular basket assembly, it will be understood that the invention is applicable to other open wire support structures, such as shelves and other configuration baskets.

While a specific embodiment of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerator storage assembly comprising:

a pair of elongated support members for mounting in spaced apart, side-by-side relationship within a refrigerator; each of said support members including an elongated storage structure support surface extending front to rear within the refrigerator and a flange extending along said support surface and projecting toward the other of said support members;

a storage structure of open wire construction including a bottom having a plurality of longitudinally elongated rods extending in spaced apart, side-by-side relationship front to rear of said storage structure;

a pair of elongated mounting members, each of said mounting members including elongated walls forming a recess to receive one of a corresponding pair of rods along a corresponding lateral edge of said storage structure and each of said mounting members also including an additional wall and ribs forming spaced apart detents to receive the other of said corresponding pair of rods for mounting said mounting member to said storage structure by inserting its recess around said corresponding one of said corresponding pair of said rods and then rotating said mounting member to bring its detents into register with said corresponding other of said corresponding pair of said rods;

each of said mounting members having an elongated mounting surface resting on said support surface of a corresponding support member for sliding movement of said storage structure between a first position fully received within the refrigerator and a second position partially out of the refrigerator; and each of said mounting members having at least one lip extending downward inside and outward under said flange of said corresponding support member.

2. A storage assembly as set forth in claim 1, wherein:

each of said support members includes a tab adjacent the front of its flange and projecting toward said other support member; and said at least one lip of each of said mounting members is positioned to engage said tab of the corresponding support member and prevent movement of the storage structure outward of said refrigerator beyond its second position.

3. A storage assembly as set forth in claim 1, wherein:

each of said mounting members has a plurality of lips spaced apart front to rear of that mounting member with the front most lip positioned a predetermined distance to the rear of the front of that mounting member; and each of said support members includes a tab at a predetermined position relative to its front and projecting toward said other support member;

whereby said front most lip of each mounting member engages said tab of said corresponding support member to prevent movement of said storage structure outward of the refrigerator beyond its second position.

4. A storage assembly as set forth in claim 1, further comprising: a stop member removably mounted to each of said support members just to the rear of said mounting members when said storage structure is in its first position.

5. A storage assembly as set forth in claim 1, wherein: said storage structure support surface of each of said support members lies in a plane angled from the vertical to face outward and upward and said mounting surface of each of said mounting members lies in a plane angled from the vertical to face inward and downward so that said support surfaces of said support members and mounting surfaces of said mounting members guide said storage structure for smooth sliding movement between its first and second positions.

6. In a refrigerator having a storage compartment with a rear wall and a pair of ladder tracks secured to said rear wall in spaced apart vertical orientation; a storage basket assembly including:

a pair of basket support members including a base portion removably secured to a corresponding one of said ladder tracks, a generally vertically oriented wall extending forward of said base portion within said compartment above said vertical wall, and a flange projecting generally horizontally inward of said support surface;

a storage basket including a bottom wall formed of a plurality of spaced apart longitudinal rods extending front to rear of the compartment;

a pair of elongated mounting members interfitting with adjacent pairs of rods along corresponding lateral edge portions of said basket bottom wall;

each of said mounting members having a mounting surface resting on said support surface of a corresponding support member for selective sliding movement of said basket between a first position fully received within said compartment and a second position partially out of said compartment;

each of said mounting members having at least one lip extending downward inside and outward under said flange of said corresponding support member; and a stop member mounted to each of said support members just to the rear of said corresponding mounting member when said storage basket is in its first position.

7. A storage basket assembly as set forth in claim 6, wherein:

each of said support members includes a tab adjacent the front of its flange and projecting toward said other support member; and said at least one lip of each of said mounting members is positioned to engage said tab of the corresponding support member and prevent movement of the storage structure outward of said refrigerator beyond its second position.

8. A storage basket assembly as set forth in claim 6, wherein:

each of said mounting members has a plurality of lips spaced apart front to rear of that mounting member with the front most lip positioned a predetermined distance to the rear of the front of that mounting member; and a tab is formed adjacent the front of each of said support member flanges and projects toward said other support member;

whereby said front most lip of each mounting member engages said tab of said corresponding support member to prevent movement of said storage structure outward of the refrigerator beyond its second position.

9. A storage basket assembly as set forth in claim 6, wherein: each of said mounting members includes elongated walls forming a recess to receive one of said corresponding pair of basket rods and each of said mounting members also includes an additional wall and ribs forming longitudinally spaced apart detents to receive the other of said corresponding pair of basket rods so that said mounting member is mounted to said basket by inserting its recess around said corresponding one of said corresponding pair of said basket rods and then rotating said mounting member to bring its detents into register with said corresponding other of said corresponding pair of said basket rods.

10. A storage basket assembly as set forth in claim 6, wherein: said storage basket support surface of each of said support members lies in a plane angled from the vertical to face outward and upward and said mounting surface of each of said mounting members lies in a plane angled from the vertical to face inward and downward so that said support surfaces of said support members and mounting surfaces of said mounting members guide said storage basket for smooth sliding movement between its first and second positions.

* * * * *